US005382319A

United States Patent [19]

Tumminaro, Jr.

[11] Patent Number: 5,382,319

[45] Date of Patent: Jan. 17, 1995

[54] SOLUTION AND PROCESS FOR CHEMICALLY RESHARPENING SMOOTHING TOOLS, FORMING TOOLS AND CUTTING TOOLS

[76] Inventor: Anthony J. Tumminaro, Jr., P.O. Box 105, Gardena, N. Dak. 58739

[21] Appl. No.: 133,995

[22] Filed: Oct. 12, 1993

[51] Int. Cl.[6] ..... C23F 1/00

[52] U.S. Cl. ..... 156/664; 252/79.2; 252/79.4

[58] Field of Search ..... 156/664, 665, 666; 252/79.2, 79.4; 134/3, 41

[56] References Cited

U.S. PATENT DOCUMENTS 4,070,193 1/1978 Tucker ..... 156/666 X
4,668,421 5/1987 Dollman ..... 134/3 X
4,940,493 7/1990 Neidiffer et al. ..... 134/3
5,019,288 5/1991 Garcia ..... 252/79.4 X

*Primary Examiner*—Thi Dang
*Attorney, Agent, or Firm*—David A. Lingbeck

[57] ABSTRACT

This invention relates to a solution and process for chemically resharpening smoothing, forming, and cutting tools such as files, jigsaw blades, hacksaw blades, coping saw blades, bandsaw blades, and the like. The solution contains preferred concentrations of phosphoric acid, anionic and nonionic surfactants including ethyl alcohol and distilled water. The tools are immersed in the solution for a period of 2 to 5 hours depending upon the wear to the tools, after which the tools are removed, wiped, and allowed to air dry to allow a rust resistant coating from the solution to adhere to the tools.

4 Claims, 2 Drawing Sheets

SOLUTION AND PROCESS FOR CHEMICALLY RESHARPENING SMOOTHING TOOLS, FORMING TOOLS AND CUTTING TOOLS

BACKGROUND OF THE INVENTION

This invention relates to a solution and process for chemically sharpening smoothing tools, forming tools, and cutting tools, such as files and the like, which are made of metal and can be used to smooth, form, or cut wood, metal, plastic, laminate, and the like.

Conventionally, there are a wide variety of solutions and processes for sharpening tools and blades. None of the prior art describes a solution and process for chemically resharpening files and the like as described in the present invention.

One known prior art is a BLADE SHARPENING SOLUTION AND PROCESS, U.S. Pat. No. 3,492,178, comprising an etching solution of essentially ten percent chromic acid, fifteen percent sulfuric acid, fifteen percent magnesium hydroxide, fifteen percent aluminum hydroxide, three percent calcium carbonate, two percent magnesium trisilicate, and thirty-four percent distilled water into which stainless steel razor blades are immersed and removed after a period of time and dried.

Another known prior art is a METHOD AND APPARATUS FOR RESHARPENING CUTTING TOOLS BY ELECTROPOLISHING PROCESS, U.S. Pat. No. 4,406,759, which comprises immersing the cutting tools in an electrolytic solution and DC voltage is applied between the tool, which serves as an anode, and a cathode plate immersed in the solution to thereby polish the edge of the tools by dissolution.

Another known prior art is a METHOD AND BATH FOR ELECTROCHEMICALLY RESHARPENING OF CUTTING TOOLS, U.S. Pat. No. 4,710,279, comprising an aqueous solution of phosphoric acid and sulfuric acid to which is added stabilizers of chromic acid, nickel carbonate and ferric oxide. An electrical potential is applied to the cutting tool within the bath within the range of one-half volt to six volts for a period of between one and twenty minutes.

None of the prior art describe or even suggest the present invention of resharpening forming and smoothing tools in addition to cutting tools using a solution of chemicals not described or suggested by any of the prior art. There is a definite need for a solution and process for chemically resharpening forming, smoothing, and cutting tools and the like.

SUMMARY OF THE INVENTION

The present invention relates to a solution and process for chemically resharpening forming, smoothing, and cutting tools and the like. The solution comprises preferably 18.75% phosphoric acid, 5% anionic and nonionic surfactant containing ethyl alcohol, and 76.25% distilled water thoroughly mixed therein, all of which is placed in a non-reactive tank having side walls and a bottom wall. The tools to be resharpened can be placed on a carriage having slots at the top to receive the tools and having a bottom for the tools to rest upon. The carriage with the tools thereon are lowered into the tank so that the tools are completely immersed in the solution. The tools remain immersed in the tank for a period of preferably 2 to 5 hours depending upon the degree of wear and the types of teeth of the tools such as files and the like with the average immersion time being 2½ to 3 hours, after which the carriage is removed from the solution and the excess solution is drained and the tools dried to allow a rust resistant coating from the solution to adhere to the tools which are preferably files but may also be router bits and other miscellaneous tools.

It is an object of the present invention to provide a solution and process for resharpening forming, smoothing, and cutting tools, in particular, files, which saves the user of such tools money not having to always buy new files as such whenever the old files become dull, the cost to resharpen used files being in the range of 1/10 to 1/30 the cost of new files.

Another object of the present invention is to provide a solution and process for resharpening forming, smoothing, and cutting tools which is safe for the user to use unlike the chemicals used in the prior art, which are known to be harmful to the blood, bone marrow, and kidneys as such of the user.

Also, another object of the present invention is to provide a solution and process for resharpening forming, smoothing, and cutting tools, which is environmentally safe to use.

Yet, another object of the present invention is to provide a solution and process for resharpening forming, smoothing, and cutting tools, which is simple to do and is relatively labor free.

Further objects and advantages of the present invention will become more apparent as the description proceeds and when taken in conjunction with the accompanying drawings wherein:

DETAILED DESCRIPTION OF THE INVENTION

Figure 1:
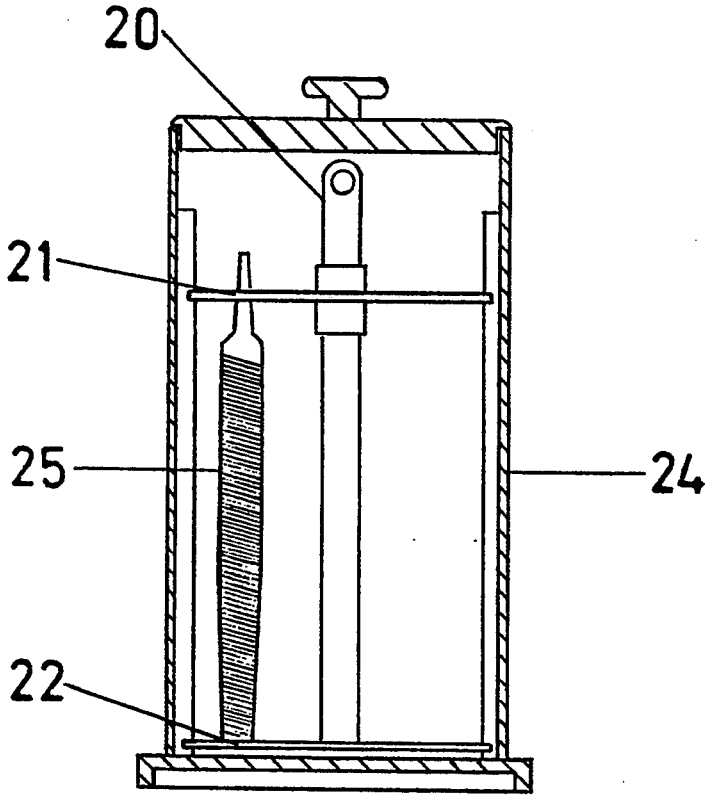
FIG. 1 is a sectional side elevation view of the non-reactive tank preferably used in which the solution of chemicals or bath is placed and showing a tool immersed therein.

As demonstrated and illustrated in FIGS. 1 through 5 of the drawings, the present invention relates to a solution and process of chemically resharpening forming, smoothing, and cutting tools 25, in particular, files as such. In a preferred embodiment, the solution should comprise 18.75% by volume of phosphoric acid; 5% by volume of anionic and nonionic surfactant selected from the group consisting of (1) linear alkyl benzene sulfonic acid, (2) sodium lauryl sulfate, (3) sodium dodecylbenzene sulfonate, (4) ammonium lauryl sulfate, and (5) alkylphenoxypolyoxyethylene; including ethyl alcohol; and 76.25% by volume of distilled water, all thoroughly mixed together and placed in a non-reactive tank 24 as is shown in FIG. 1, and the solution having a temperature of at least 55 degrees Fahrenheit and having a volume great enough so that the tools 25 are completely immersed therein.

Figure 2:
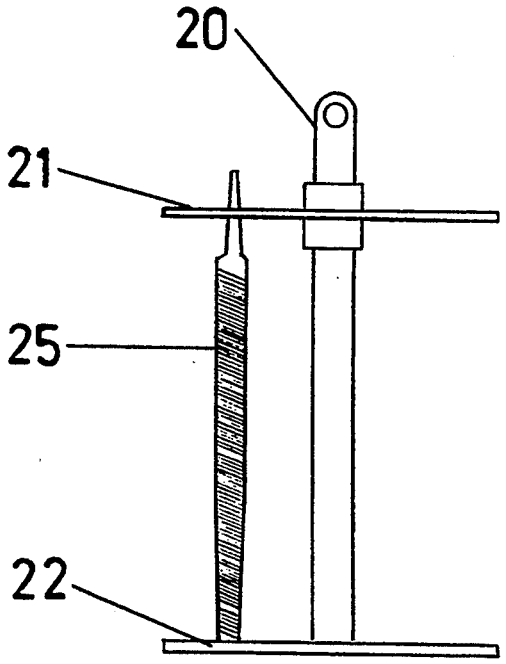
FIG. 2 is a side elevation view of the carriage means used, upon which the files and tools can be placed for immersion in the tank containing the solution.
Figure 3:
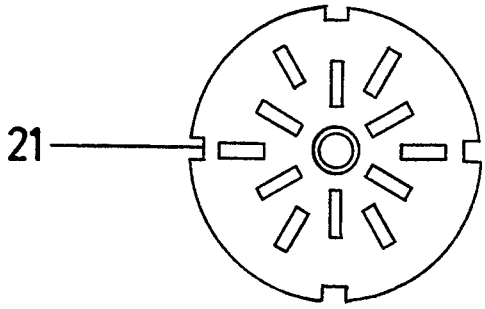
FIG. 3 is a top plan view of the slotted plate mounted at the top of the carriage, through which the files and tools can be inserted to rest upon the carriage for immersion into the tank.
Figure 4:
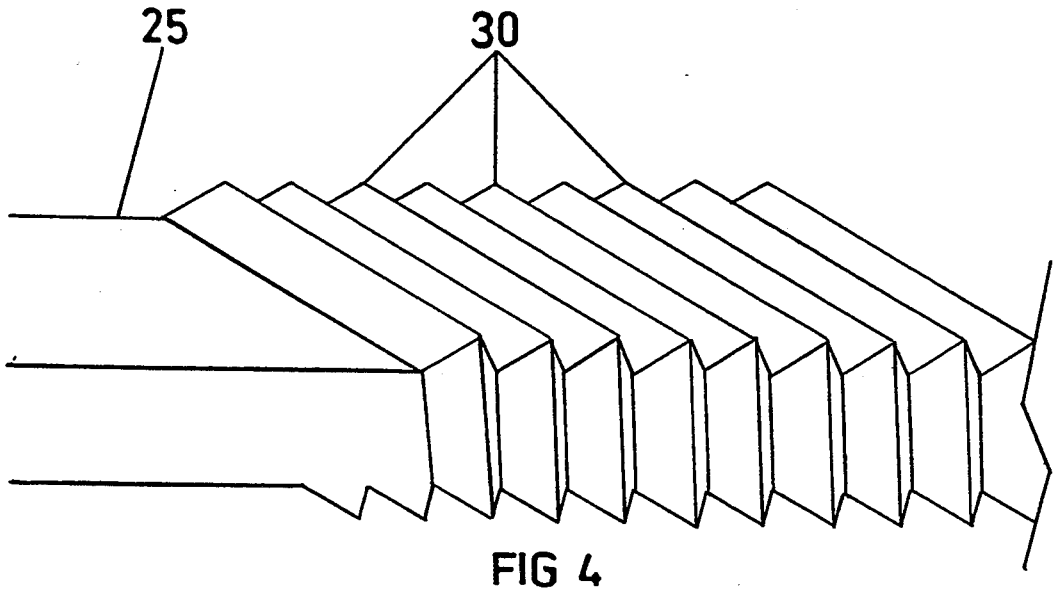
FIG. 4 is a breakaway side elevational view of the teeth of a file after they have been resharpened by the bath of chemicals of this invention.
Figure 5:
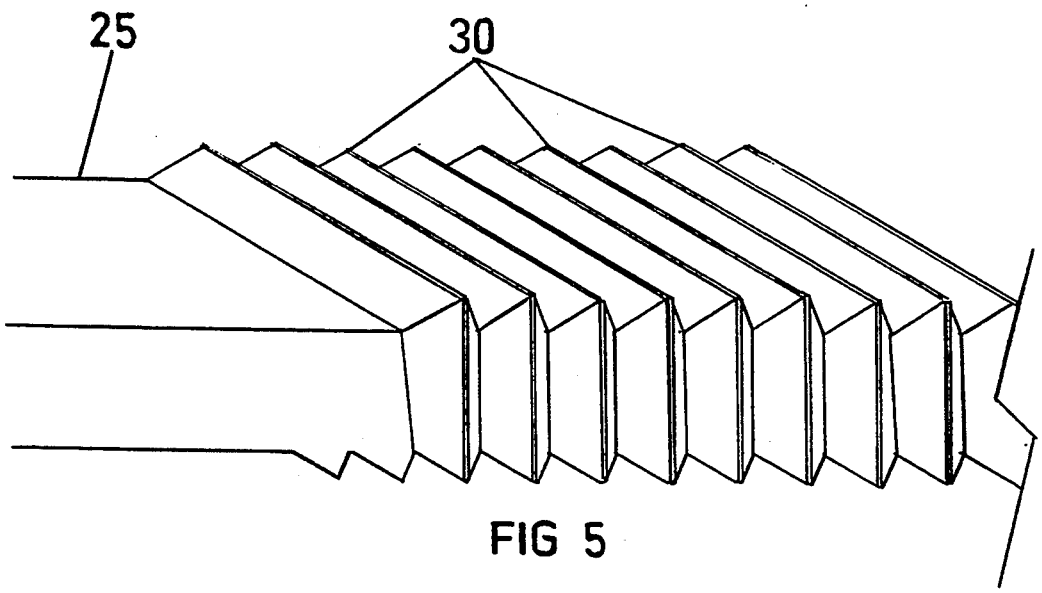
FIG. 5 is a breakaway side elevational view of the teeth of a file before they have been resharpened by the bath of chemicals of this invention, showing the dullness of the teeth.

As shown in FIGS. 2 and 3, the tools 25 can be placed on a carriage 20 having an upper slotted plate 21 fixedly attached thereto, through which the tools 25 such as files can be inserted to rest upon a bottom plate 22 of the carriage 20. As shown in FIG. 1, the carriage 20 containing the tools 25 are then placed in the tank 24 with the tools 25 being completely immersed in the solution containing the chemicals for resharpening the tools 25 which preferably should remain immersed in the solution for a period of 2 to 5 hours, upon which the solution chemically resharpens the tools 25 by evenly etching, carving, and cutting and sharpening the cutting edges 30 of the tools 25 and after which the carriage 20 and the tools 25 can be removed from the solution and tank 24, wiped and air dried, and are ready for use with the once-dull teeth or cutting edges resharpened as shown in FIGS. 4 and 5. The solution, in addition to containing chemicals which resharpen tools 25 such as files and the like, also comprises a rust resistant property which coats the tools 25 while immersed in the solution. Once removed from the solution, the tools 25 are wiped and allowed to air dry so that the rust resistant property coats and adheres to the tools 25.

The strength of the solution and the number of times the solution can be reused depends upon the concentration of the chemicals in the distilled water. Heavier concentrations of phosphoric acid and the anionic and nonionic surfactant including ethyl alcohol in the solution allows the user to reuse the solution more times for resharpening tools 25. For example, the solution can comprise 25% by volume of phosphoric acid, 8% by volume of anionic and nonionic surfactant including ethyl alcohol, and 67% by volume distilled water for reusing the solution more times to resharpen the tools 25. Further, the solution can comprise 15% by volume of phosphoric acid, 3.75% by volume of anionic and nonionic surfactant including ethyl alcohol, and 81.25% by volume of distilled water for the balance of the solution which is weaker and can only be reused fewer times to resharpen the tools 25.

For effective resharpening of the tools 25 such as files the chemical concentration of the solution can contain from 5% to 92% by volume phosphoric acid, from 1% to 20% by volume anionic and nonionic surfactant including ethyl alcohol, and the balance being distilled water.

As an alternate embodiment, the resharpening solution may comprise up to 95% by volume of hydrochloric acid with the balance being distilled water. In such a solution, the tool or tools 25 should be left in the solution for 2 to 15 minutes, after which the tool or tools 25 should be removed and preferably placed in a solution comprising phosphoric acid to remove any potential for surface oxidation of the tool or tools 25. The user should use extreme caution when using hydrochloric acid in the resharpening solution as it may cause serious injury to the user if the user comes into direct contact with hydrochloric acid.

As another alternate embodiment, the resharpening solution may comprise up to 95% by volume of chromic acid and sulfuric acid with the balance comprising distilled water. As with the hydrochloric acid, chromic acid, in particular is a harmful agent if the user comes into direct contact with the chemical and extreme caution should be exhibited when handling chromic acid.

What is claimed is:

1. A process to chemically resharpen or sharpen forming, smoothing, and cutting tools which comprises:

providing an aqueous solution of from about 1% to 20% by volume of anionic and nonionic surfactant with ethyl alcohol, phosphoric acid of from about 5% to 92% by volume, and distilled water in a volume sufficient for the balance of said solution;

completely immersing said tools in said solution;

subsequently removing said tools from said solution;

drying said tools; and allowing a rust resistant coating of said solution to adhere to said tools.

2. A process to chemically resharpen or sharpen forming, smoothing, and cutting tools as described in claim 1, wherein the step of providing said solutions includes providing said solution with a temperature of greater than 55 degrees Fahrenheit.

3. A process to chemically resharpen or sharpen forming, smoothing, and cutting tools as described in claim 1, wherein the step of immersing said tools in said solution includes allowing said tools to remain immersed in said solution for a period of between 2 and 5 hours.

4. A process to chemically resharpen or sharpen forming, smoothing, and cutting tools as described in claim 1, wherein the step of drying said tools includes wiping said tools and air drying said tools for said rust resistant coating to adhere to said tools.

* * * * *